US005584691A

United States Patent [19]

Domenella

[11] Patent Number: 5,584,691

[45] Date of Patent: Dec. 17, 1996

[54] DENTAL INSTRUMENT SHARPENING SYSTEM

[76] Inventor: David D. Domenella, 9716 Rte. 12, Richmond, Ill. 60071

[21] Appl. No.: 231,147

[22] Filed: Apr. 22, 1994

Related U.S. Application Data

[63] Continuation-in-part of Ser. No. 908,038, Jul. 9, 1992, Pat. No. 5,331,774.

[51] Int. Cl.[6] ..... A61C 17/00

[52] U.S. Cl. ..... 433/143; 433/141; 433/144

[58] Field of Search ..... 433/141, 143, 433/144; 40/913

[56] References Cited

U.S. PATENT DOCUMENTS

| | | | |
|---|---|---|---|
| 1,689,770 | 10/1928 | Briley | 51/17 |
| 2,911,771 | 11/1959 | Amiet | 51/102 |
| 3,098,327 | 7/1963 | Malin | 51/229 |
| 3,135,073 | 6/1964 | Odle | 51/229 |
| 4,106,240 | 8/1978 | De Bartolo | 51/229 |
| 4,626,212 | 12/1986 | Mann et al. | 433/144 |
| 4,769,955 | 9/1988 | Reiling et al. | 51/218 A |
| 5,030,091 | 7/1991 | Svanberg | 433/143 |
| 5,058,324 | 10/1991 | Snellen | 51/229 |
| 5,107,935 | 4/1992 | McBride | 269/270 |
| 5,331,774 | 7/1994 | Domenella | 51/285 |

*Primary Examiner*—Cary E. O'Connor
*Attorney, Agent, or Firm*—Greer, Burns & Crain, Ltd.

[57] ABSTRACT

A dental instrument sharpening system includes an instrument arm for holding a chiral bladed dental instrument and for facilitating movement of at least one of the chiral blades of the dental instrument to a rotatable sharpening stone. A positioning mechanism, coupled to the instrument arm, positions at least one of the chiral blades of the dental instrument in a desired predetermined position. The positioning mechanism includes a clamping mechanism and indexed slotted member. The indexed slotted member has index protrusions, such as protruding nubs, that matingly engage with indentations in the handle of the dental instrument. The handle of the dental instrument includes at least one index indentation such as a conical indentation. The index indentation and the corresponding index protrusion mate to properly position the blade of the dental instrument in a predetermined longitudinal and axial position in the clamping mechanism.

8 Claims, 12 Drawing Sheets

FIG. 2
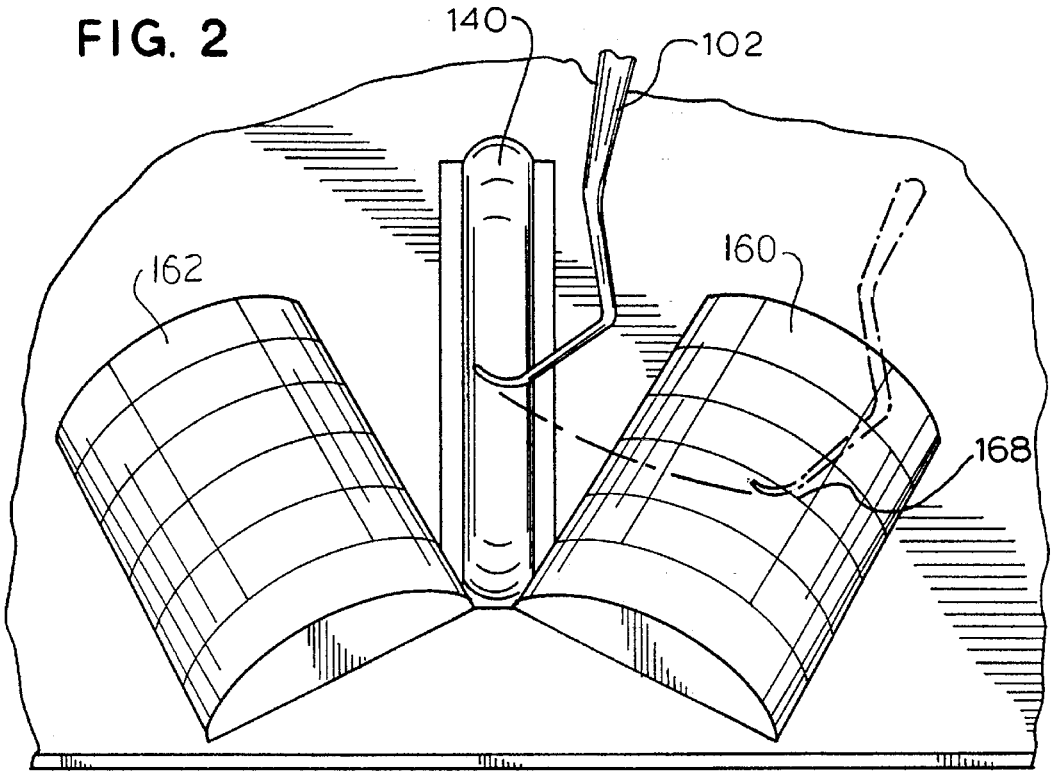
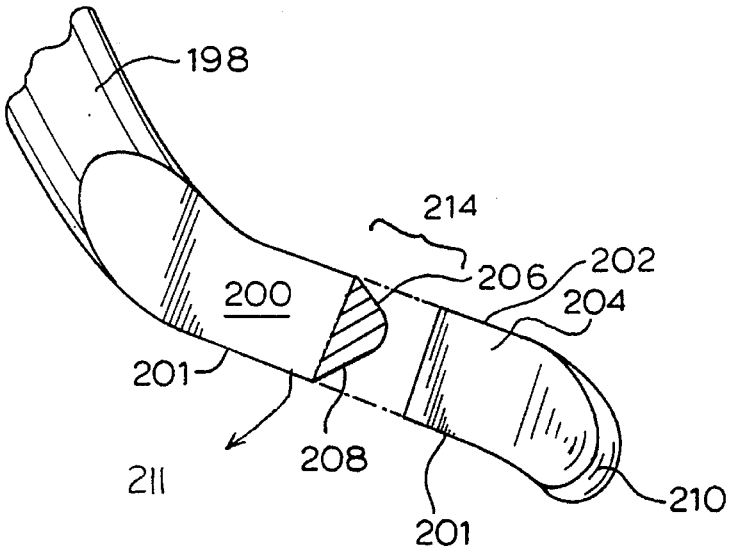
FIG. 3

FIG. 8
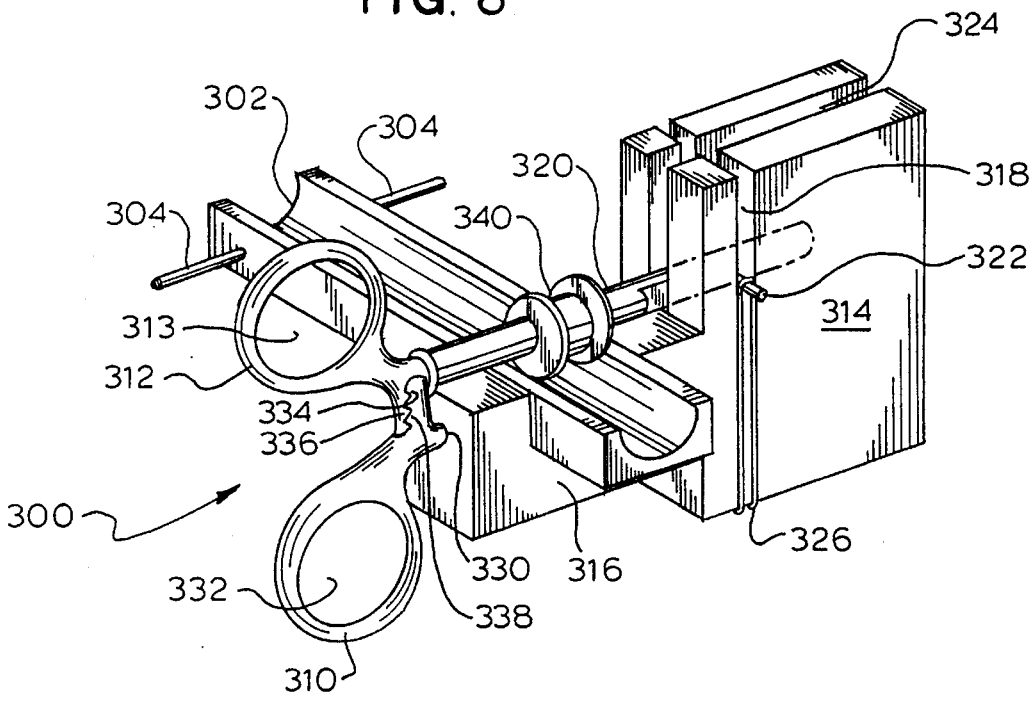
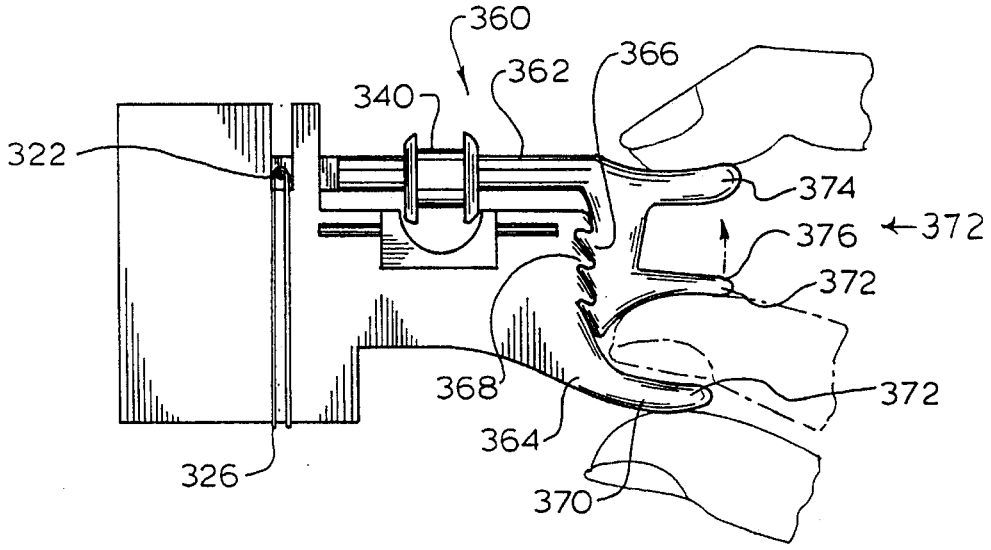
FIG. 9

FIG. 10
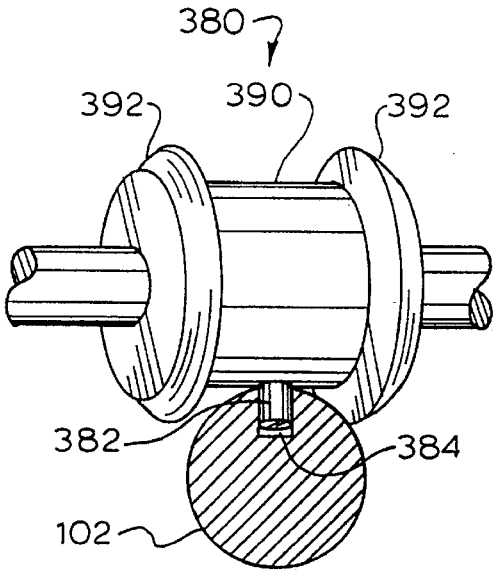
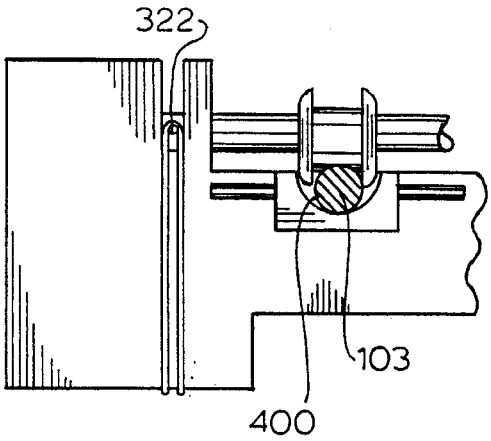
FIG. 11
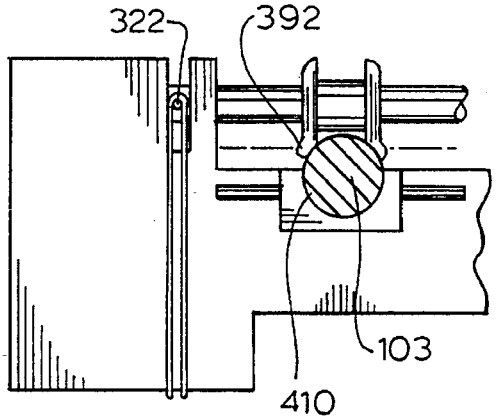
FIG. 12

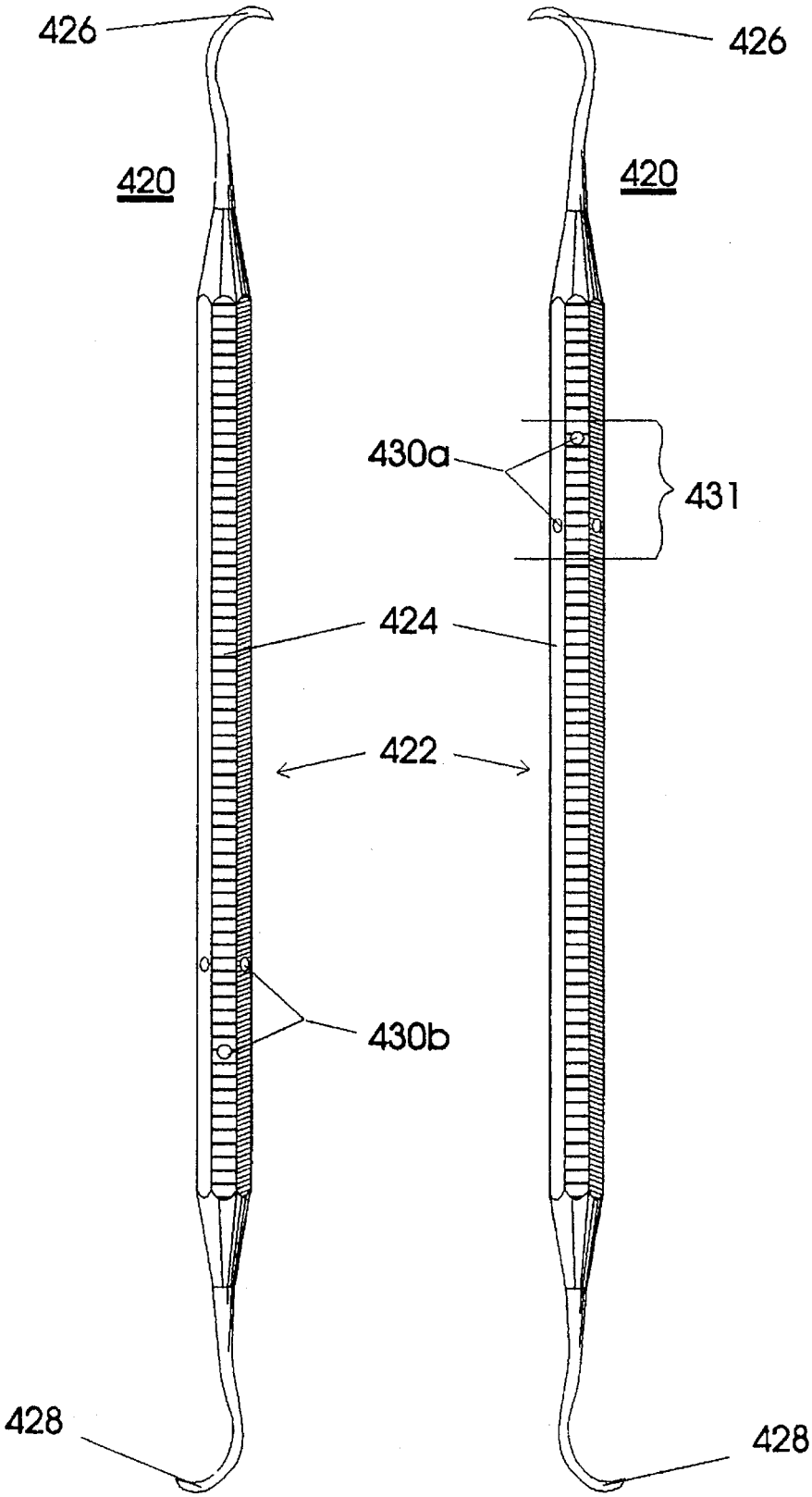
FIGURE 13a1 FIGURE 13a2

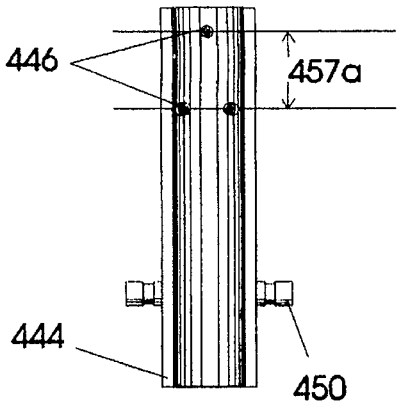
Figure 17a1
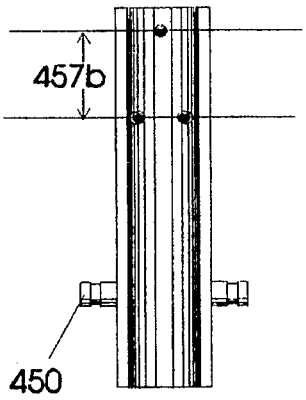
Figure 17b1
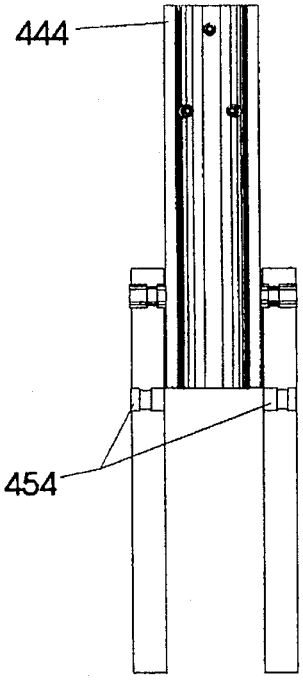
Figure 17a2
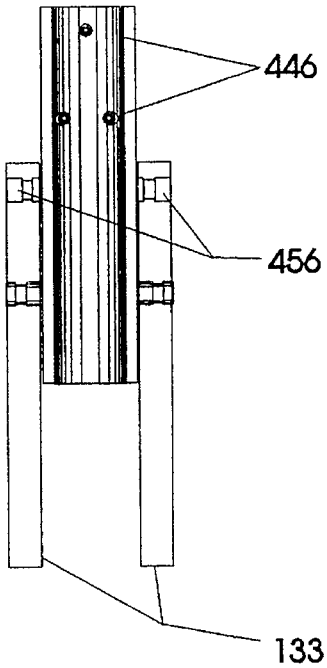
Figure 17b2

DENTAL INSTRUMENT SHARPENING SYSTEM

RELATED APPLICATION

This is a continuation-in-part application of application Ser. No. 07/908,038, filed Jul. 9, 1992, entitled "Method and Device for Sharpening Chiral Blades of Dental Instruments", now U.S. Pat. No. 5,331,774.

The invention relates to a sharpening device, and more particularly to a device for sharpening a dental instrument, the device having a separate, repetitively determinable, fixed sharpening position for each instrument.

BACKGROUND OF THE INVENTION

Gum disease is now a very prevalent human health problem. Left untreated, gum disease can cause a substantial health problem. Partial or complete loss of teeth can result from gum disease, with associated pain and discomfort therefrom. Lost teeth are, of course, a major health problem. To treat the gum disease problem, periodontal procedures are applied.

To carry out periodontal procedures, a dentist is required to use special curettes. There are many different types of curettes. The curette is used to remove hardened deposits below a patient's gum line. Each curette needs to be very sharp, in order to remove these deposits. Each instrument is designed with a different blade angle, depending on the area of the patient's mouth in which the hygienist or dentist is working. The cutting-edge of an instrument is angled or otherwise varied in this respect. When sharpening an instrument, it is very important to preserve the shape and angle of the blade.

Uniform removal of metal is important, because otherwise, the shape of the instrument can be changed; especially with regard to the angle of the surface of a lateral surface relative to the surface of the face. With few exceptions only one cutting edge per tip of an instrument and only one lateral surface must be ground during sharpening. The other lateral surface is ground on a few designs of curettes, for example a sickle or a universal.

So therefore, in order to sharpen each instrument, a machine must be designed to provide a precise and a very accurate angle for each instrument. By precise is meant that the same angle on each particular instrument must be produced every time it is sharpened. Each instrument has a different angle, for different uses in different areas of the mouth.

It is highly desirable, even required, to have sharp instruments. Still it is just too costly to replace an instrument, merely because it is dull. Yet a sharpening device to precisely produce the desired sharp edge at the desired angle is not known. In fact, there is no known sharpening device for this purpose.

All currently known sharpening devices inherently rely on the operator's hand to hold the instrument to be sharpened in the proper position with respect to the sharpening stone. This factor creates a major problem, because the position of the operator's hand may change by as much as ten degrees without knowledge thereof by the operator. This factor causes an uneven removal of the lateral surface of the instrument, making the entire sharpening process very time consuming, inefficient, and tedious.

One known sharpening device requires placing the instrument on an abrasive surface, and vibrating the instrument very rapidly back and forth thereon. The hygienist, dentist or assistant places the instrument on the stone, and attempts to angle the instrument parallel to the line of the blade. This procedure is extremely tedious because the instrument usually has a round handle; and the lateral surface of the instrument, which needs to be removed in order to grind a cutting edge, has a varying angle. The angle of some instruments varies so often, that this sharpening procedure using this device just does not work to uniformly sharpen an instrument with the required accuracy.

Another known sharpening device has angles marked on a protractor-like scale for use with each instrument to be sharpened. The defect in this instrument is that it depends on a person being able to provide the same angle with his or her hand. Unfortunately, by human error, especially without a highly skilled person doing the sharpening, this device is inherently inadequate for producing the same surface on an instrument, because the lateral surface is only about one millimeter to two millimeters in width, and which needs to be preserved in order to keep the instrument in good working condition.

SUMMARY OF THE INVENTION

Therefore, it is an objective of this invention to provide a device for uniformly sharpening a dental instrument.

A further objective of this invention is to provide a device for properly honing a lateral surface of a dental instrument.

A still further objective of this invention is to provide a device for properly maintaining the angle of the dental instrument.

Yet a further objective of this invention is to provide a device for properly sharpening a dental instrument, which minimizes human error. Also an objective of this invention is to provide a device to reduce replacement of a dental instrument.

Another objective of this invention is to provide a device for uniformly sharpening a periodontal instrument.

Yet another objective of this invention is to provide a device for properly honing a lateral surface of a periodontal instrument.

Still another objective of this invention is to provide a device for properly maintaining the angle of a periodontal instrument.

A further objective of this invention is to provide a device for properly sharpening a periodontal instrument, which minimizes human error.

A still further objective of this invention is to provide a device to reduce replacement of a periodontal instrument.

Another object of the present invention is to provide an indexing arrangement between a dental instrument and a sharpening device to facilitate improved sharpening of the blades of the dental instrument.

It is also an object of the present invention to provide a low cost indexing arrangement between a dental instrument and a sharpening device to facilitate improved accuracy and precision in sharpening chiral bladed dental instruments.

Another object of the present invention is to provide a dental instrument having an indexing mechanism in a handle thereof that does not unduly interfere with manipulation of the instrument during normal use.

Yet a further objective of this invention is to provide a method for properly sharpening a periodontal instrument, which minimizes human error.

Also an objective of this invention is to provide a method for properly honing a lateral surface of a periodontal instrument.

A still further objective of this invention is to provide a method for properly maintaining the angle of a periodontal instrument.

Yet a further objective of this invention is to provide a method for properly sharpening a periodontal instrument, which minimizes human error.

Also an objective of this invention is to provide a method to reduce replacement of a periodontal instrument.

These and other objectives of this invention (which other objectives become clear by consideration of the specification, claims and drawings as a whole) are met by providing a sharpening device with a clamp for fixing a dental tool in a holding device at a predetermined position. The dental tool is then sharpened on a fixed, but rotatable sharpening stone. The precision sharpening device includes at least one vertically fixable tool holding mount, and at least one holding post to permit the tool holding mount to move horizontally to the sharpening stone. The tool mount cooperates with the clamp to achieve the desired result. A positioning guide may also be used to determine the locking position of the tool in the clamp prior to moving the tool to the sharpening stone.

In another embodiment, the device includes an instrument arm for holding the dental instrument and for facilitating movement of at least one of the chiral blades of the dental instrument to the rotatable sharpening stone. A positioning mechanism, coupled to the instrument arm, positions at least one of the chiral blades of the dental instrument in a desired predetermined position. The positioning mechanism includes a clamping mechanism, such as a squeeze clamp with a slotted member. The slotted member matingly engages with indentations in the handle of the dental instrument.

The handle of the dental instrument includes at least one index indentation such as a conical indentation. The slotted member includes at least one corresponding index protrusion, such as a mating conical-shaped protruding hub. The index indentation and the corresponding index protrusion mate to properly position the blade of the dental instrument in a predetermined longitudinal and axial position in the clamping mechanism. There may be a plurality of index indentations and corresponding protruding nubs that align and mate to provide additional stability and insure a suitable blade sharpening position.

A unique chiral bladed dental instrument having a hollow handle and a chiral blade at opposing ends thereof includes a plurality of index indentations located in the outer surface of the handle for matingly engaging with corresponding protruding nubs in the clamping mechanism. The handle includes at least two distinct sets of index indentations where one set is used to position one of the chiral blades and the other set is used to position the second chiral blade.

BRIEF DESCRIPTION OF THE DRAWINGS

FIG. 2 depicts a portion of a top, plan view of the dental instrument sharpening device of FIG. 1 showing two positioning guides wherein a blade of a dental instrument is positioned with respect to the positioning guides.

FIG. 3 depicts a perspective view of a blade of a dental instrument.

FIG. 8 depicts an instrument holding device with a scissors clamp.

FIG. 9 depicts the instrument holding device with a squeeze clamp.

FIG. 10 depicts a perspective view of the rubber mounting grommet with an index pin for locating or positioning the instrument.

FIG. 11 depicts a view of a small handled instrument and its location within a clamp.

FIG. 12 depicts a view of a larger handled instrument and its location within a clamp.

FIGS. **13*a*1 and 13*a*2** are perspective views illustrating a chiral bladed dental instrument in accordance with the invention.

FIGS. **13*b*, 13*c* and 13*d* are partial perspective views indicating various arrangements of index indentations for a dental instrument of the type shown in FIG. 13*a***.

FIG. **14*a*** is a perspective view of one embodiment of a clamping mechanism in accordance with the invention.

Figure 14B:
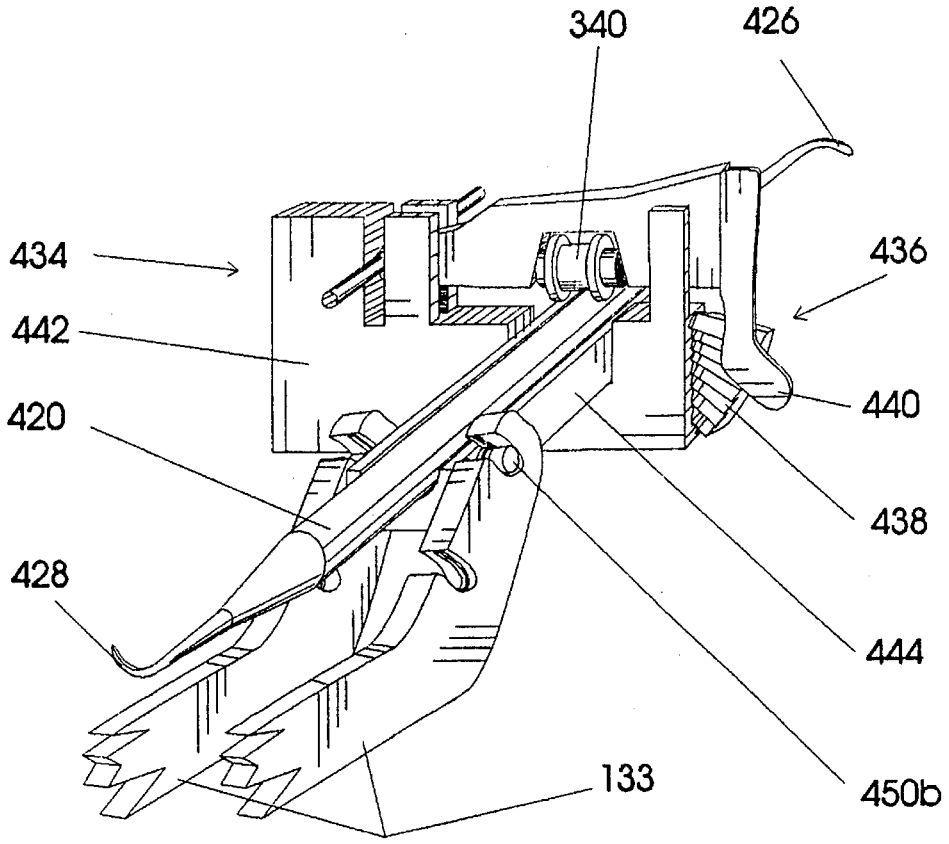
Figure 14A:
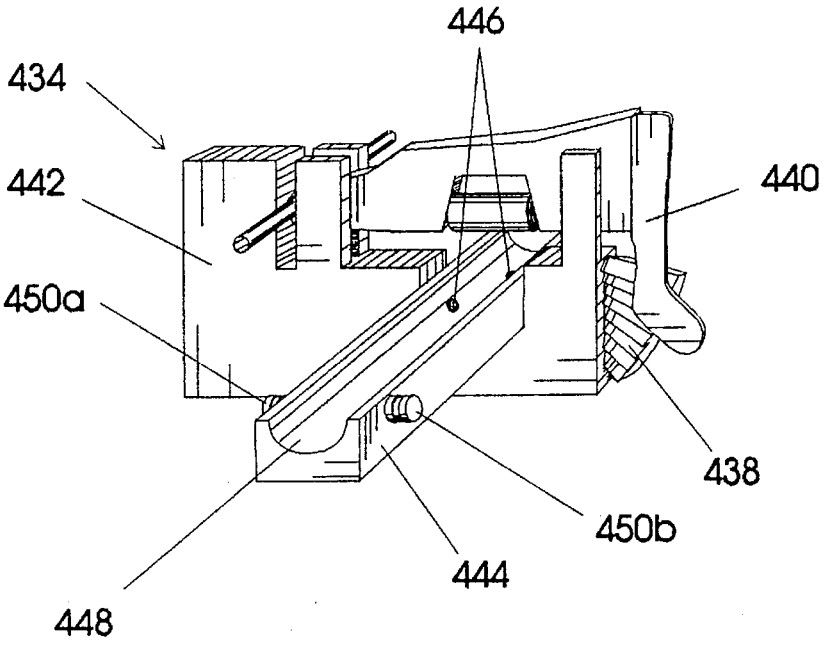

FIG. **14*b* shows a dental instrument clamped in the clamping mechanism of FIG. 14*a***.

Figure 15:
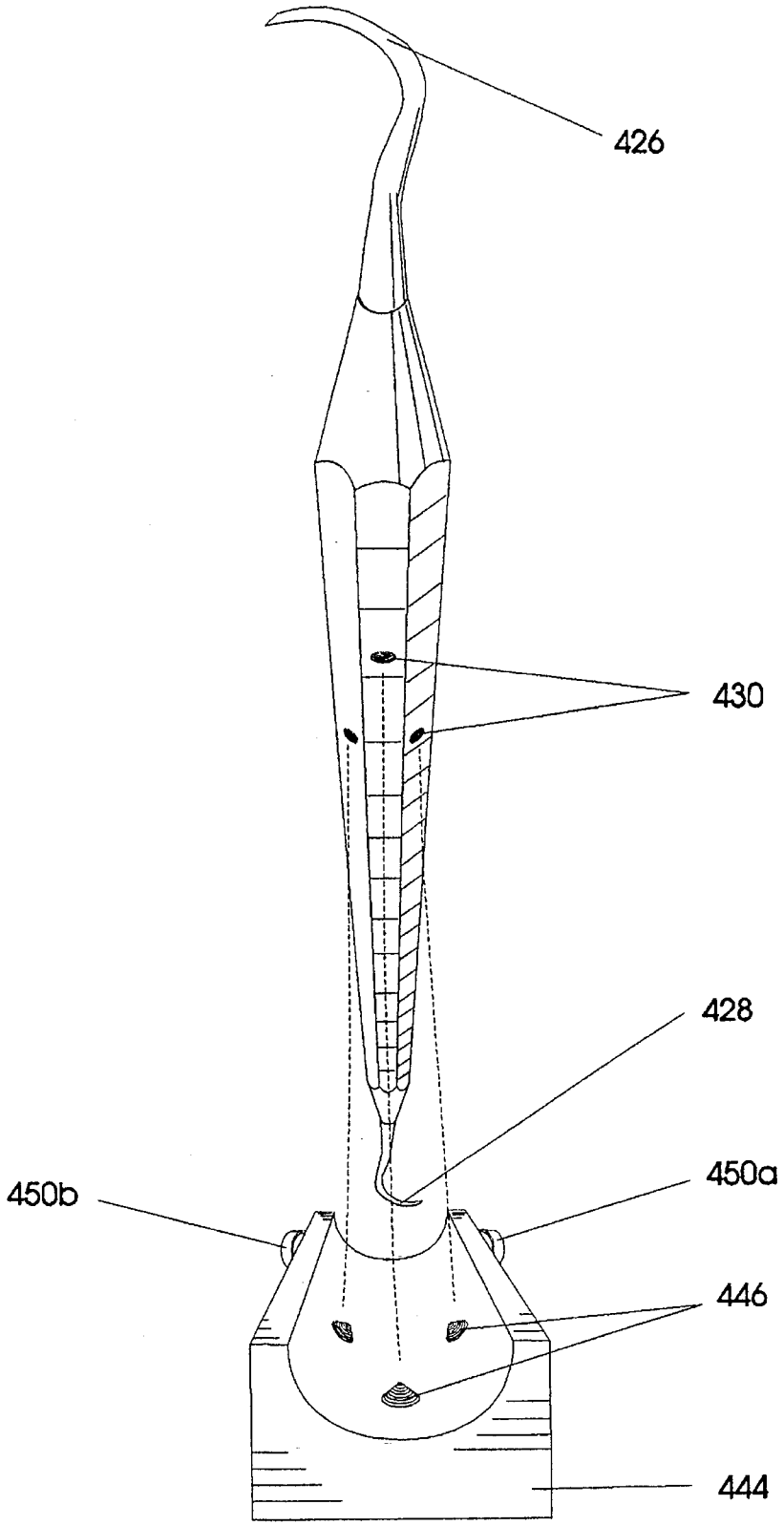

FIG. 15 is an exploded view of a dental instrument and corresponding indexed slotted member in accordance with the invention.

FIGS. **16*a* and 16*b*** show a partial perspective view and plan view of an index slotted member connected to an instrument receiving arm in accordance with the invention.

FIGS. **17*a*1, 17*a*2, 17*b*1 and 17*b*2** are plan views illustrating an indexed slotted member and an instrument receiving arm in accordance with the invention.

Throughout the figures of the drawings, where the same part appears in more than one figure of the drawings, the same number is applied thereto.

DESCRIPTION OF THE PREFERRED EMBODIMENTS

In order to describe the dental instrument sharpening device in technical detail, certain geometrical postulates must be established so as to simplify the use or explanation of the device. This dental instrument sharpening device is very specifically dedicated to sharpening a dental curette which is used by a dentist in periodontal procedures. Each instrument needs to be very sharp. Also, each instrument is designed with a different angle for its blade (or cutting or scraping surface) depending on which area of the patient's mouth the instrument is used. Furthermore, the cutting edge, in some instruments, has a plurality of different angles within the same blade.

The cutting edge of the instrument is that which is formed by two surfaces. Sharpening of the edge is done by grinding one of those surfaces. The most desirable result being that the original orientation of the ground surface to the rest of the object being sharpened is preserved each time. This orientation of the ground surface will be referred to here as the angle. The cutting edge of the curette is determined by which edge of the curette is encountered by the tooth surface when the instrument is pulled over the tooth in the direction of the cutting action (as shown by the arrow in FIG. 3). Most types of curettes only have one cutting edge per end. Curettes are generally double-ended with the designs of the two ends having chirality (that is one end is a mirror image of the other). Therefore, the device described herein has a right positioning guide and a left positioning guide, each of which are essentially mirror images of each other; one positioning guide to sharpen one end of an instrument and the other positioning guide to sharpen the other end.

In order to sharpen an instrument properly, an instrument sharpening device or machine must provide a precise and very accurate angle. By precise is meant that the same angle on that particular instrument is produced every time it is sharpened. By accuracy is meant that the same angle as originally manufactured on that instrument is preserved as that instrument is sharpened.

The device described here positions the instrument in a correct three dimensional position by using two positioning criteria simultaneously. The basis of the sharpening device is the linear, tangential qualities of the guidance system. Thus, the guidance system is a linear tangential guide, because it is linear and tangential. First the instrument is placed linearly on the guide, while in the instrument clamp. The instrument is then locked in place by the instrument clamp to restrict its longitudinal movement and to achieve tangential position with respect to the guide.

The guide provides an empirical scale, which is used to determine proper position for each instrument. A new or otherwise perfectly sharpened instrument is placed in the clamp and in proper contact with the sharpening stone. This new instrument is then moved to the guide. The point of contact by the instrument on the guide is then permanently marked in a suitable fashion for that instrument.

Within the instrument and the clamp, an appropriate second type of positioning guide is practical. The clamp may have a fixed pin therein. A fixed indentation on the handle of each instrument combines with the pin to properly position the instrument for application to the sharpening stone. With this feature present, the previously discussed positioning guide becomes optional.

When a dull instrument of the same type is desired to be sharpened, that dull instrument is placed in the clamp with the edge desired to be sharpened in contact with the guide at the marked position. The dull instrument is then secured in the clamp and the preferred sharpening position is achieved in the clamp.

Then the clamped instrument is moved horizontally from its position on the positioning guide to the sharpening wheel. At that point the blade of instrument forms a tangent to the grinding wheel at the desired sharpening angle. The tangent, that is the line that is tangent with the grinding wheel, is actually where the lateral surface of the sharpened instrument will be, and is where the lateral surface is being produced on the end of the instrument.

The device described here most preferably uses about a 5.1 centimeter (two inch) diameter Arkansas Stone, which operates at high speed in the direction noted in the drawings. Other stone sizes are suitable with appropriate adjustments in other dimensions of the device, but this one is preferred. Grinding of the lateral surface in order to produce the sharp cutting edge is done with the cutting edge lying across the wheel substantially perpendicular to the geometric plane of the wheel.

Therefore, technically the sharpening device is actually placing a new lateral surface on the instrument which is a concave surface and not actually a flat surface. However, due to the fact that the curettes normally sharpened with the device are only about 1.5 millimeter in width, the concave curvature is negligible, and the surface of the lateral surface produced by the device will be considered to be planar. During sharpening, the lateral surface will be at an angle that is tangent to the circumference of the wheel at the center of the area of contact by the lateral surface of the instrument. The posts may be made of any suitable material. The posts receive the instrument arm in slidable fashion. The instrument arm includes a cylinder at one end thereof, and an instrument clamp at the other end thereof. The cylinder, which slides over the posts and positions the instrument clamp, permits the instrument arm to move horizontally. However, it is a tight fit permitting both free movement and a fixed position around a vertical axis.

In this fashion, the instrument can be moved from the graduated positioning guide to the instrument wheel. The graduated device positions the instrument for locking in the clamp. In this fashion, the instrument can be applied to the grinding wheel in substantially the same position every time. Thus, the edge on the instrument is maintained as desired.

One end of the instrument is sharpened in the first clamp. The second end is sharpened in the second clamp on the other post. There is usually only one cutting edge on each end of the instrument. This structure of the sharpening device is very simple, but very effective. As the instrument is moved longitudinally in the clamp(when the clamp is not tightened), the angle of sharpening changes on the grinding wheel. Thus, any angle of blade of any curette can be sharpened in this device.

Turning now to FIG. 1, FIG. 2, FIG. 3, and FIG. 4 the dental instrument sharpening device 100 of this invention includes a base 120 having an electric motor 130 and grinding wheel 140 secured thereto in a standard fashion. Mounted above the base 120 and substantially parallel thereto is guidance platform 150. Within the guidance platform 150 is a grinder slot 152 capable of receiving grinding wheel 140. Grinder slot 152 is of sufficient size to permit grinding wheel 140 to enter therein and protrude therefrom without touching guidance platform 150. The grinding wheel 140 is powered by the electric motor 130 due to a standard connection therewith by belt 131.

Also mounted on the base 120 are a first post 122 and a second post 124. First post 122 and second post 124 are each mounted so that with respect to the imaginary center-line 142 the device 100 has a left portion 121 and a right portion 123 which are substantially mirror images of each other. When viewing FIG. 1, grinding wheel 140 rotates in a clockwise fashion.

To elaborate, the parts of the instrument 102 as displayed in FIG. 3 must be defined. Instrument 102, such as for example a curette 198, includes a blade 200. The first cutting edge 201 of blade 200 is that which is formed between the face 204 and the first lateral surface 208. If the end 210 of the curette 198 is pointed, it is called the tip. If the end 210 of the curette 198 is rounded, it is called the toe. FIG. 3 depicts end 210 as a toe.

The typical curette 198 shown in FIG. 3 has a toe at end 210. In the central region 214 of the curette 198 are the first cutting edge 201 and the second cutting edge 202. First cutting edge 201 is formed at face 204 and lateral surface 208. Second cutting edge 202 is formed at face 204 and second lateral surface 206. The curette 198 includes blade 200. The cutting action is indicated as moving away from the end 210 (as shown by the arrow 211 in FIG. 3).

The process of sharpening the first cutting edge 201 involves the uniform removal of metal from the surface of the first lateral surface 208. As can be seen in FIG. 3, second lateral surface 206 terminates in second cutting edge 202. Uniform removal of metal is important, because otherwise its shape is changed—especially the angle formed by the surface of the first lateral surface 208 and the surface of the face 204. With few exceptions, only first cutting edge 201 per blade 200 of an instrument 102 and only one lateral surface must be ground during sharpening. The second lateral surface 206 is ground on a few designs of curettes, for example, sickles and universals.

Figure 1:
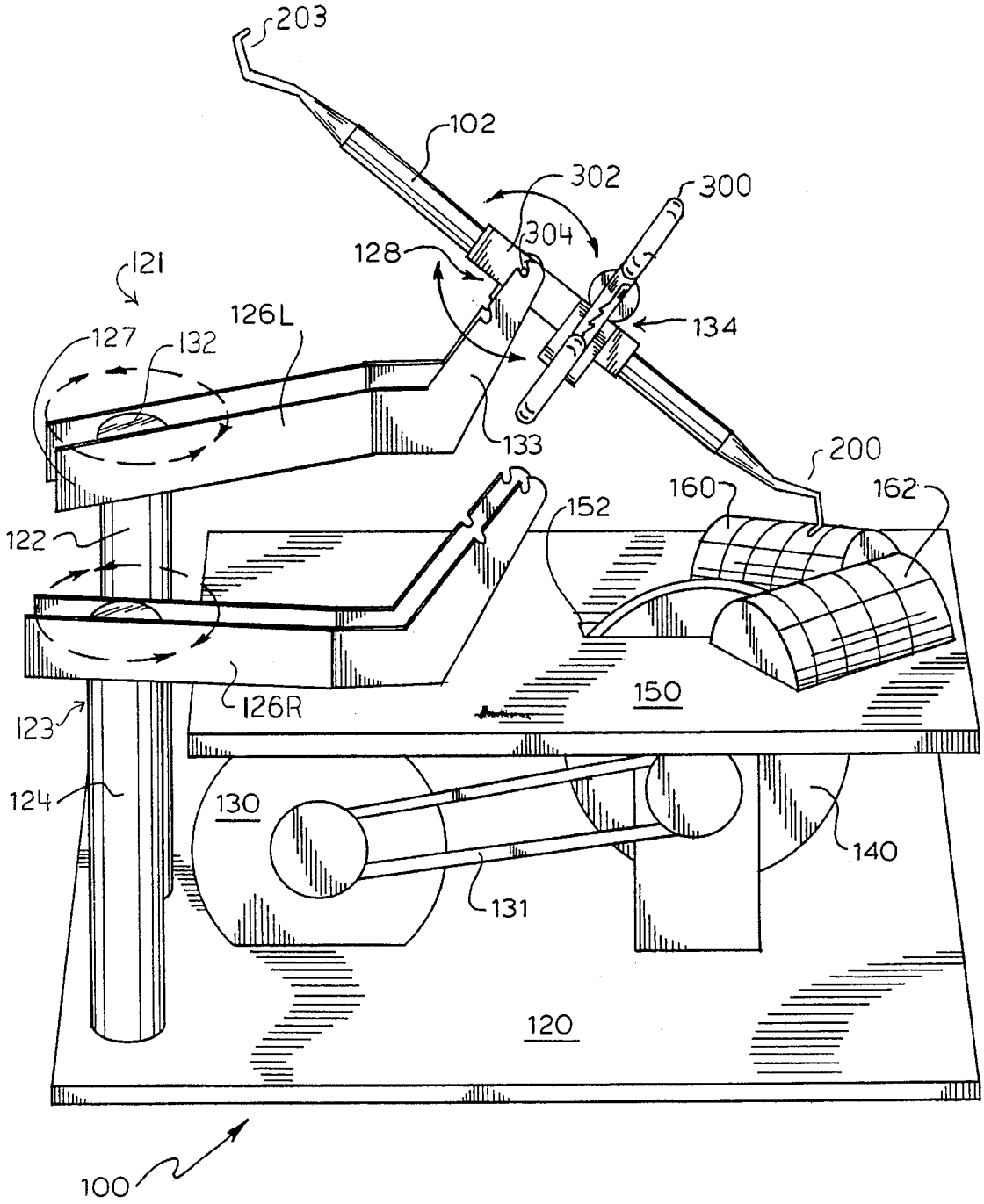
FIG. 1 depicts a side, top, perspective view of dental instrument sharpening device in accordance with one embodiment of the invention.
Figure 4:
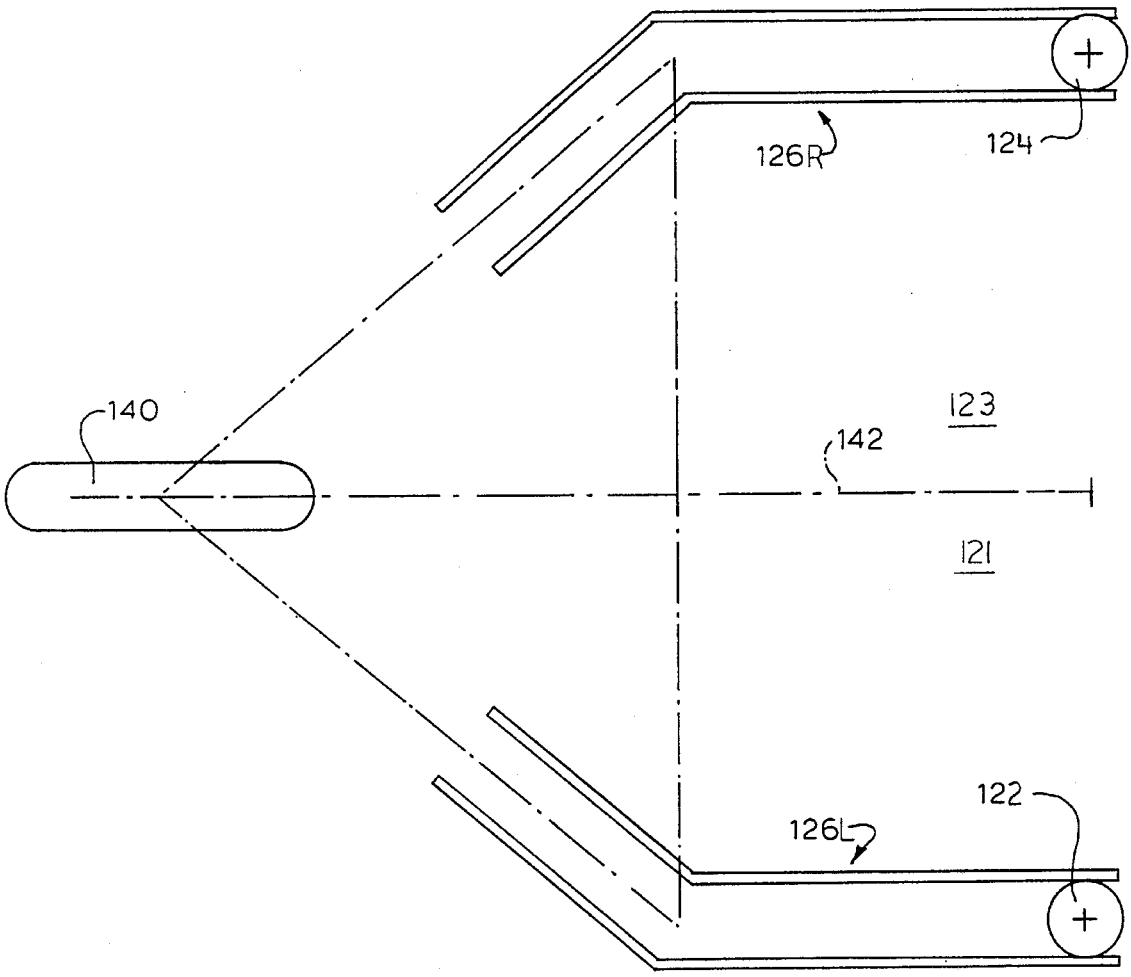
FIG. 4 depicts a top, plan view of a dental instrument sharpening device generally depicting the fixed holding posts and grinding wheel.

When considering FIG. 1 and FIG. 4, first post 122 and second post 124 are each rigid members capable of receiving instrument arms 126L and 126R respectively thereon. One or more of instrument arm 126L and 126R may be used. It will be recognized that the instrument arm 126R may be used in the same manor as instrument arm 126L as shown in FIG. 1.

Referring now to FIG. 1, explanation will be made with reference to the left portion, however, it will be recognized that the same description applies to the right portion. Instrument arm 126L has a post end 127 and a clamp end 128. Post end 127 generally includes a hollow cylinder 132 capable of slidably mounting over first post 122, in a pivotal fashion. Instrument arm 126L rotates horizontally, but is fixed vertically.

Opposite post end 127 is an instrument receiving arm 133. Pivotally mounted within instrument receiving arm 133 about a horizontal axis (formed by pins 304, to be described with reference to FIG. 8) is instrument clamp 134. When a dental instrument, such as instrument 102, is placed in instrument clamp 134, the instrument 102 may be fixedly secured therein. Appropriate positioning of the instrument 102 creates correspondence between the blade 200 to be sharpened and indicia on either first positioning guide 160 or second positioning guide 162. Once so positioned, the instrument is locked in clamp 134 by hand tightening or other suitable means, so that movement thereof is horizontal about the first post 122, that is to grinding wheel 140 for sharpening; and vertical in up down fashion about the horizontal axis to permit proper contact with both the grinding wheel 140, and indicia 168 on first positioning guide 160.

Indicia 168 are determined empirically and marked permanently on either first positioning guide 160 or second positioning guide 162. Indicia 168 are made by a standard dental pigment, such as an oxide coating. Another method may also be used to make indicia 168.

Adjacent the grinding wheel 140 on either side thereof, on raised platform 150, is first positioning guide 160 and a second positioning guide 162. The first positioning guide 160 and second positioning guide 162 are preferably semi-cylindrical in shape, and may have graduated indicia thereon.

Flat positioning guides are also operable. But the flat device does not have the capacity to record the axial position of the clamped instrument. Axial positioning is discussed below.

It is feasible to take a sharpened instrument 102 and place the appropriate edge of the sharpened instrument 102 or new instrument 102 on the positioning guide. At that point an empirical mark is created for the instrument 102 on either positioning guide. Thus, when an instrument 102 of the same type is desired to be sharpened, it may be secured in the clamp and fixably mounted in the same position.

In this fashion, movement of the clamped instrument 102 from a scale or a predetermined point on the appropriate positioning guide to the grinding wheel 140 keeps the instrument 102 in perfect position for sharpening. In this fashion, the angle and desired setup of the instrument 102 is maintained. The pivoting member of the arm 126L permits the instrument 102 to be moved from the indicia on first positioning guide 160 onto the grinding wheel 140. The second positioning guide 162 permits the other end of the instrument 102 to be sharpened when the instrument is in a clamp on 126R. Thus, with the fixed height of the instrument receiving arm 133, the horizontal movement thereof, the fixed horizontal axis of pins 304, and the clamp 134, the clamped instrument 102 is fixedly mounted and permitted to be sharpened in a desired fashion.

The device 100 positions the instrument 102 in a correct three dimensional position for sharpening by using two positioning criteria simultaneously:

(1) longitudinal (or linear) positioning and (2) axial positioning.

These two positioning elements provide for a simplified device 100.

By longitudinal positioning is meant that the instrument 102 can be locked in place by the clamp 134 at any position along its length. The position of the point of contact to the abrasive grinding wheel 140 changes as the linear position is changed. At each different linear position, a different tangential angle is created between the grinding wheel 140 and the instrument 102, and therefore a different angle may be imparted to the instrument 102.

Axial positioning refers to the rotated position of the instrument 102 along its axis or handle. Rotating the handle (or central portion between the two ends) of the instrument 102 changes its axial position. That position is determined on the first positioning guide 160 or second positioning guide 162 by virtue of the semi-cylindrical shape of the positioning guide.

In order to consistently produce the same surface on the instrument 102 during each sharpening cycle, the instrument 102 must be fixed at the same position. The two positioning criteria are recorded simultaneously by marking first positioning guide 160 or second positioning guide 162 as below described for each instrument 102 to be sharpened. A very precise positioning of the instrument 102 can be accomplished by always placing the same point of the instrument 102 on the same, empirically-determined point on first positioning guide 160 or second positioning guide 162.

The operator of the device 100 can choose any point on the blade 200 of the instrument 102 that he or she wishes to use as a visual reference point as long as that same visual reference point is used thereafter in subsequent sharpening cycles. By experience, through empirical testing for each of instrument 102, the best positioning technique is to position the central region of the blade (as indicated in FIG. 3 at central region 214) directly on one predetermined point designated as the indicia or the guide point for that particular design of an instrument 102 so that the blade 200, such as first lateral surface 208, or cutting edge 201 of the instrument 102, is tangential to the circular shape of the guide.

After establishing the guide points all other instruments of the same design to be sharpened are locked in place on the linear tangential guide so that the central region of the blade 200 makes contact with that same predetermined point on the appropriate positioning guide 160 or 162. It can then be moved to the grinding wheel to be sharpened in the proper position by the pivoting of arm 126L about its vertical axis as described earlier.

The instrument 102 or specifically curette 198 is then placed in clamp 134 and in contact with its predetermined point. Then the instrument 102 is locked in place securely so that it will not move in clamp 134 while instrument 102 is being sharpened. The clamped instrument 102 may then be moved and placed in contact with the abrasive grinding wheel 140 for sharpening.

Figure 5:
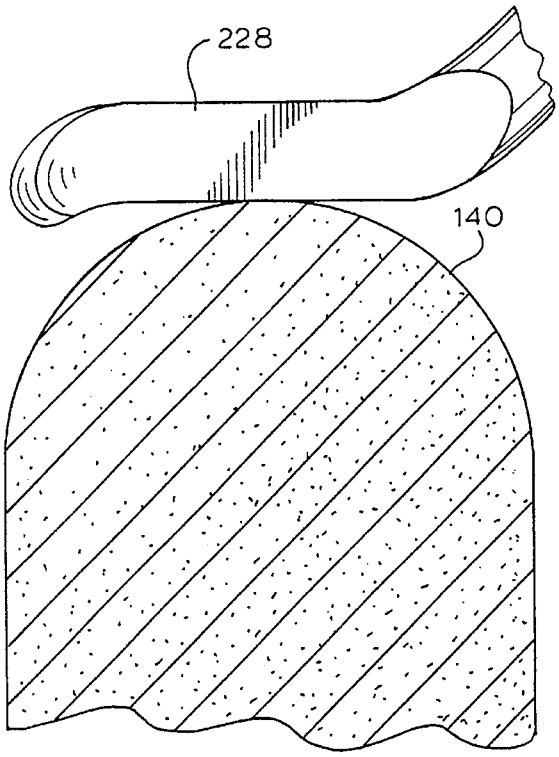
FIG. 5 depicts an end view of a grinding wheel of the dental instrument sharpening device of FIG. 1 having the dental in proper axial position on the grinding wheel.
Figure 6:
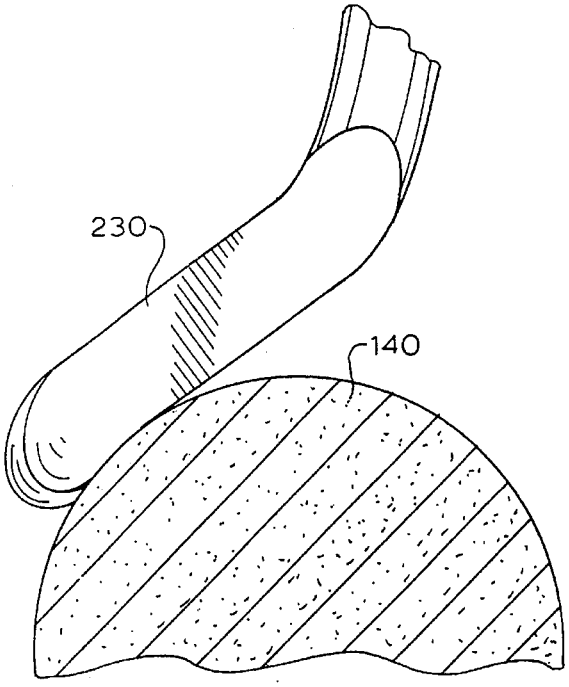
FIG. 6 depicts an end view of the grinding wheel of the dental instrument sharpening device in FIG. 1 having the dental instrument in improper counterclockwise position on the grinding wheel.
Figure 7:
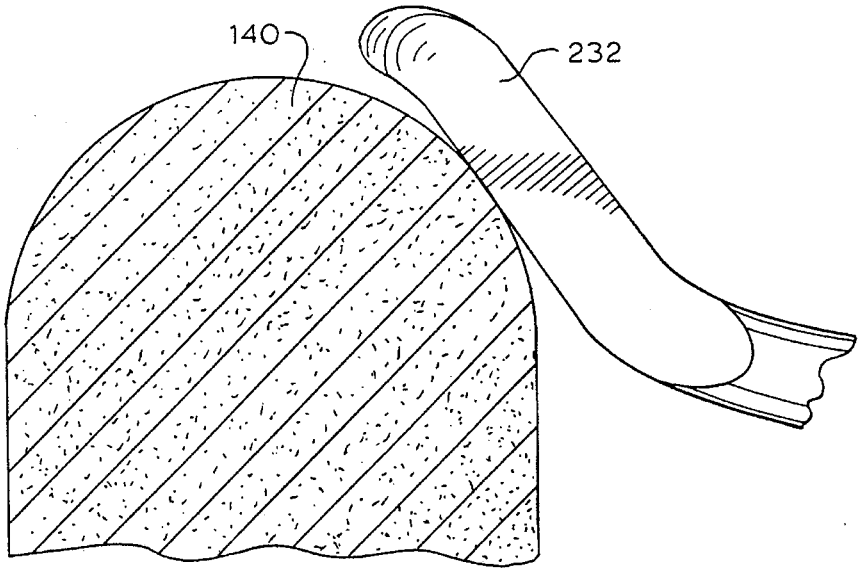
FIG. 7 depicts an end view of the grinding wheel of the dental instrument sharpening device of FIG. 1 having the dental instrument in improper clockwise position on the grinding wheel.

Referring now to FIG. 5, FIG. 6, and FIG. 7, various axial positions of the curette 102 on the grinding wheel 140 are shown. FIG. 5 shows the proper position 228 of the instrument 102 on grinding wheel 140. FIG. 6, depicts an improper counterclockwise, axial position 230 for curette 102, which results in improper sharpening. Likewise FIG. 7 depicts an improper clockwise, axial position 232 which also provides for improper sharpening. It is critical that this correct position 228 be achieved.

In FIG. 8, a scissors clamp 300 can replace clamp 134 and provide a great deal of flexibility for device 100, while clamping an instrument 102 therein. Scissors clamp 300 includes a slot 302 for holding the instrument. Slot 302 receives a handle 103 of an instrument 102 therein. Slot 302 is a trenchlike affair in a rectangular solid member 303 having a semi-cylindrical slot (slot 302) therealong for receiving the handle 103 of the instrument 102.

The rectangular solid member 303 includes a pair of mounting pins 304 for mounting in the instrument arm 133 of device 100. The instrument 102 is held in the clamp by a scissors mechanism having a fixed handle 310 and a movable handle 312. Moveable handle 312 is mounted in a handle block 314.

Handle block 314 includes a fixed block 316 having fixed handle 310 fixed thereon. Within handle block 314 is a longitudinal slot 324 for receiving an opposing hinged end 320 of movable handle 312. Movable handle 312 includes a movable aperture 313 for receiving a finger (not shown) of an operator. Situated in hinged end 320 of movable handle 312 is a hinge pin 322 which fits movably in vertical slot 318 of block 314. An elastic member 326 wraps around the block 314 and flexibly holds the hinge pin 322 in the vertical slot 318.

Fixed handle 310 has fixed end 330 secured to fixed block 316 and fixed aperture 332 oppositely disposed therefrom. Situated between fixed end 330 and fixed aperture 332 are fixed teeth 334. Movable handle 312 has moveable teeth 336 situated between in hinged end 320 and movable aperture 313. Fixed teeth 334 and movable teeth 336 mesh and lock an instrument 102 in slot 302 in a ratchet type mechanism 338.

Situated between the movable aperture 313 and handle block 314, and over the slot 302 is a rubber grommet 340 capable of holding instrument 102 in slot 302. This is especially true when the instrument 102 is clamped therein by virtue of the ratchet mechanism 338 and the grommet 340. The instrument 102 is separated therefrom by causing the ratchet mechanism 338 to separate and release.

When considering FIG. 9, the squeeze clamp 360 provides a great deal of flexibility and is the preferred method for clamping an instrument 102 in the device. The squeeze clamp 360 can be operated with one hand and is easily released. Again the hinge pin 322 and the elastic member 326 hold the instrument 102 in slot 302.

The squeeze clamp 360 includes an upper movable lever 362 and a lower fixed lever 364 capable of being squeezed together. By so squeezing together the clamp teeth 366 lock to the block teeth 368 and cause the instrument 102 to be fastened therein.

The upper movable lever 362 includes flexible handle 372 having an upper bar 374 and a lower bar 376. By squeezing upper bar 374 toward lower bar 376, the clamp teeth 366 release from the block teeth 368 and cause the instrument 102 to be released therefrom.

Common to both the squeeze clamp 360 and the scissors clamp 300 of FIG. 8 and FIG. 9 is the elastic member 326 and rubber mounting grommet 340 for holding an instrument 102 in either clamping device. The rubber mounting grommet 340 fits around the handle 103 of a dental instrument 102. With the rubber mounting grommet 340, the clamping device can lock and hold the instrument in place.

FIG. 10 depicts a pinned rubber mounting grommet 380 with a precision index pin 382 protruding therefrom. If an instrument 102 has an appropriate precision instrument pin aperture 384 for receiving the precision index pin 382 therein positioned properly on the handle thereof, the positioning guides 160 and 162 on sharpening device 100 can be eliminated. The pinned and clamped instrument 102 can then proceed directly to the wheel 140 for sharpening. A particular location of the pin aperture 384 on the instrument combined with the pin 382 and the rubber grommet 380 permits the correct positioning of the instrument 102 so that it may be properly sharpened.

The key matter is to use the precision index pin 382 to cooperate with precision instrument pin aperture 384 and clamp to lock the instrument 102 into place in the longitudinal and axial positions as discussed previously. With the movement of the mounting clamp in the horizontal and vertical directions, the instrument 102 can be sharpened on the grinding wheel 140 after being positioned and locked in the clamp. With this structure and the index pin 382, the proper position of the instrument 102 for sharpening is consistently reproduced. By using pin 382 and precision instrument pin aperture 384, both first positioning guide 160 and second positioning guide 162 become optional or eliminable.

Referring now to FIG. 11, a small handled instrument 400 is held by the rubber grommet 380. In FIG. 12, the larger handled instrument 410 is held because the grommet 380 holds it and the larger handled instrument 410 forces flanges 392 outwardly. The grommet 380 is basically a flanged cylindrical member having a central cylindrical portion 390 substantially surrounding the movable arm while at the same time having flanges 392 extending therefrom and achieving the desired holding mechanism. In this fashion, the desired results can be easily obtained. The clamping action combined with the pin 382 and the rubber grommet 380 permits the correct positioning of the instrument 102 so that it may be sharpened.

The grinding wheel 140 is generally about 5.1 centimeters (two inches) in diameter, and is generally of the powderless type known as a jeweler's wheel. Any suitable grinding wheel 140 may be used, so long as it shows substantially no wear or the wear does not affect the sharpening angle. Typically the grinding wheel 140 is available from the Charles Dvorkin Company of Chicago, Ill.

The electric motor 130 is a typical motor. It maybe, but is not required to be, especially suitable for use in medical systems. The standard belt 131 is used to drive from the drive pulley of electric motor 130 to the grinding wheel pulley and spin the grinding wheel 140 as desired. It is also permitted to have a chain drive or direct drive of the grinding wheel 140. However, this belt 131 structure is preferred.

For example, an instrument 102 called a 13/14 Gracey curette has a certain angle thereon. This angle is actually a standard angle for this instrument 102. Each instrument 102 has a recorded certain position on either first positioning guide 160 or second positioning guide 162 for each instrument blade, where the lateral surface needs to be placed for positioning.

The positions are arbitrary due to the fact that the whole idea is that each design of instrument 102 needs its own particular placement in the clamp to be properly sharpened on the grinding wheel 140. Usually, the instruments are operated with a pulling action. Device 100 is especially suitable for sharpening those instruments.

A sickle as an example of instrument 102, is placed, before it is sharpened, in the clamp, then aligned right on top of that empirically determined point for the sickle, and, while so aligned as a tangent of that predetermined position of that semicircular first positioning guide 160 or second positioning guide 162, secured in the clamp. The sickle, then while locked in position, is then brought over to and sharpened on the grinding wheel 140 or disk.

The whole idea is that everything related to sharpening each instrument 102 is standard as to position. This method produces a very precise and very systematic way of sharpening any instrument 102 as opposed to doing it by hand. The device 100 of this invention avoids so much error involved and greatly reduces the time to sharpen an instrument 102.

The first priority in sharpening a dental instrument 102 is to set up in a well lighted area using a high intensity lamp or the light from a dental unit. With the specific sharpening position for an instrument 102 determined by either first measuring device 160 or second measuring device 162; or the combination of the precision index pin 382, precision instrument pin aperture 384 and the pinned rubber mounting grommet 380 the required dexterity for sharpening instrument 102 is greatly reduced.

Although the indexing mechanism is an index pin 382 in a rubber grommet 380 which engages with an aperture 384 in the handle of the dental instrument handle 103, any mechanical mating of the instrument handle 103 with the instrument clamp 300 that maintains the instrument in a stable position during sharpening may be used. Such a mating arrangement wherein the handle uniquely engages the instrument clamp 300, substantially eliminates any minor operator judgement that may be required in using the positioning guides as previously described.

For example, FIGS. **13*a*1 and 13*a*2 show opposing views of a preferred chiral bladed dental instrument 420 having a hollow handle 422 with an outer surface 424. A first chiral blade 426 and a second chiral blade 428 are located at opposing ends of the hollow handle 422. A plurality of index indentations, such as dimples are generally indicated as 430*a*. The index indentations are located in the outer surface 424 in an index indentation section 431. The index indentations 430*a*** matingly engage with corresponding index protrusions in an instrument holding device to position the blade of the dental instrument in a desired longitudinal and axial position as will be described below.

FIGS. **13*a*1 and 13*a*2 show another set of index indentations 430*b* located on the other end of dental instrument 420. Hence the hollow handle 424 includes at least two distinct sets of index indentations 430*a* and 430*b***. One set determines the correct longitudinal and axial position of one of the chiral blades and the other set determines the correct longitudinal and axial position of the second chiral blade. Each set of index indentations is located at the end of the handle in proximity to the blades as shown. Although the index indentations may also be located closer to the center of the handle, it is more desirable to locate the indentations in proximity to the blade to which they correspond.

FIG. **13*b* shows the outer surface 424 as being a conventional octagonal surface with eight flat surfaces and eight corners. However, other shapes of outer surface may also be used. For example, the instrument may also have a round handle. The interior of the handle 422** is defined by a hollow center that reduces the weight of the instrument.

The index indentations 430 are drilled or otherwise molded into the flat side surfaces of the handle. As shown, the index indentations are conical indentations, the shape formed by a standard drill bit which would most economically place indentations in the instrument. However, other shapes may also be used. The index indentations are indented into the handle to maintain a suitable handle grasping surface as opposed to protrusions extending out from the handle.

It is preferable that the index indentations 430 do not extend deep enough to reach the hollow center. This is to avoid the possibility of particulate getting into the hollow portion and preventing easy cleaning and sterilization of the instrument before and after use.

Figures 13B, 13C:
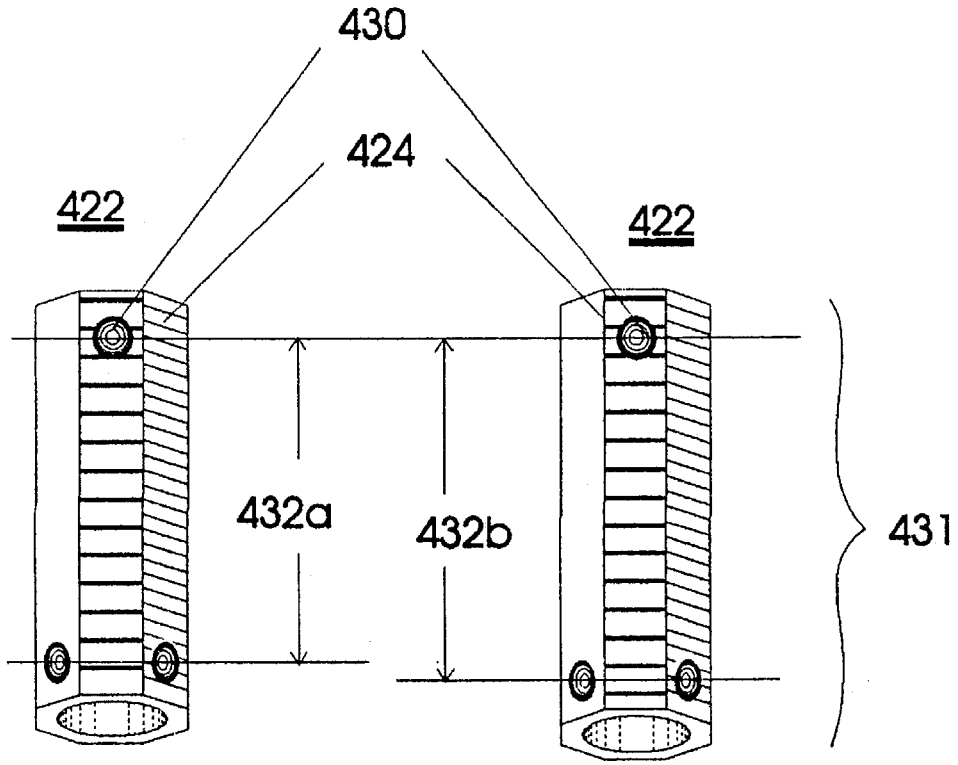
Figure 13D:
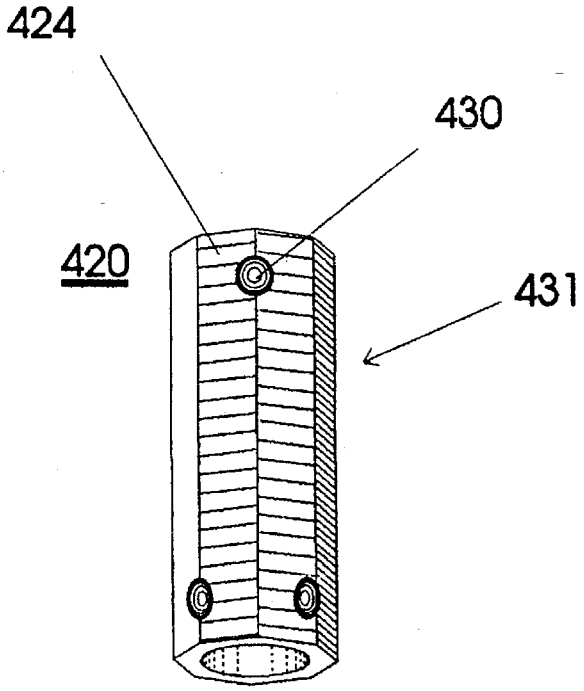

In the preferred embodiment, there are three index indentations located in a triangular pattern in the index indentation section 431 to provide stability of the handles within the index slotted member (FIG. 15). Two indentations are separated from a third indentation by indentation distance **432*a*. However, it will be recognized that any number of suitably located index indentations may be appropriate depending on the type of instrument and outer surface of the handle. FIG. 13*c* shows another indentation distance 432*b* such as may be desired for a dental instrument having a different type of blade. FIG. 13*d*** shows index indentations located on corners of the handle surface compared with index indentations located on the flat side surfaces of the handle.

FIG. **14*a* illustrates an alternative embodiment of a dental instrument positioning mechanism to that shown and described with reference to FIG. 10 (rubber grommet, not shown). FIG. 14*b* shows the positioning mechanism with the dental instrument locked in place. A clamping mechanism generally indicated at 434 operates substantially the same as that described with reference to FIGS. 8 and 9. A squeeze clamp 436 includes offset teeth 438 with a movable interlocking lever 440. A cylindrical plastic member affixed to the movable lever 440 holds the rubber grommet 340. The offset teeth 438 are affixed to the block 442. For simplicity, the rubber band is not shown. The block 442 holds an indexed rectangular slotted member 444. The indexed rectangular slotted member 444 is identical to the member 303 except that it includes index protrusions generally indicated at 446. The index protrusions are conical nubs that protrude from a slot 448 in the indexed slotted member 444. The index protrusions 446 are typically casted or machined as part of the indexed slotted member 444**.

As shown in FIG. 15, the index indentations 430 in the dental instrument are aligned and matingly engage with the corresponding index protrusions 446 in the instrument indexed slotted member 444 to position the blade of the dental instrument in a desired longitudinal and axial position. The clamp 436 securely holds the positioned instrument in place during sharpening as described above.

Figure 16A:
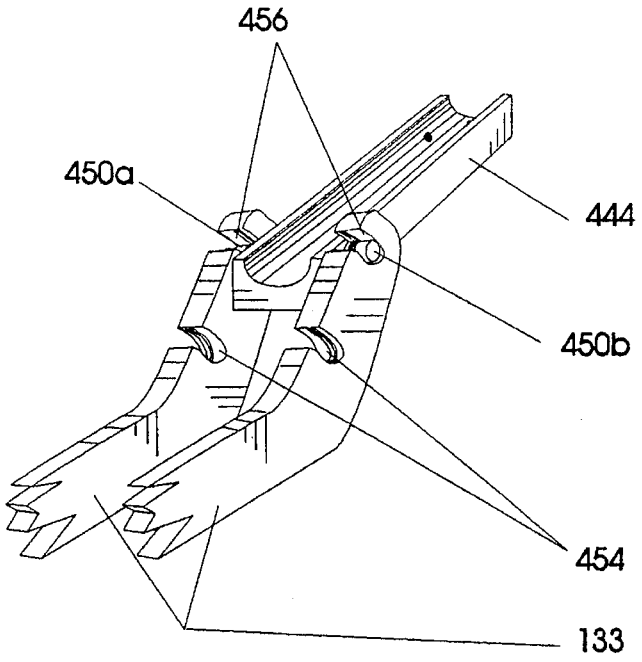
Figure 16B:
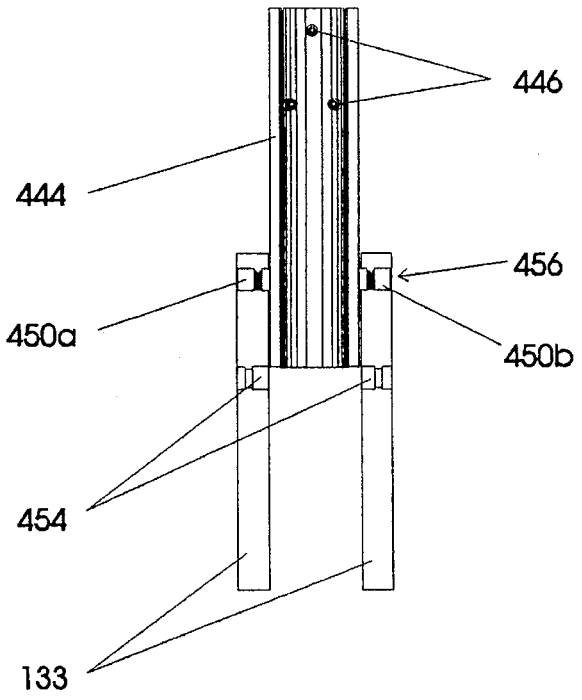

Referring to FIG. 16, the indexed slotted rectangular member 444 includes mounting pins **450*a* and 450*b* which are insertable into notch pairs in the instrument arm 133. The range of blade angles for various types of instruments are accommodated by the notch location in the instrument arm 133. A lower notch pair 454 and an upper notch pair 456** are shown, however more may be used if necessary. Each notch pair receives a unique pair of mounting pins from an indexed slotted member.

FIGS. 17*a*1, 17*a*2, 17*b*1 and 17*b*2 illustrate the two indexed slotted members having differing index protrusion distances 457*a* and 457*b* and different mounting pins. As shown, the mounting pins of each indexed slotted member have differing designs, enabling them to only fit into one notch pair (454 or 456).

For example, depending upon the blade angle (or into which range of blade angles a particular blade angle falls), some designs of chiral bladed instruments require being positioned in an indexed slotted member whose pins fit in the lower notch pair 454. Other instruments may require being positioned in a different indexed slotted member whose pins fit only in the upper notch pair 456. Such a unique pin/notch configuration eliminates the need for a knowledge of the range of blade angles into which a particular blade angle falls. Preferably, each indexed slotted member design is identical except for two features: each has a unique index protrusion distance; and each has a particular shape of mounting pins that will fit into only the proper notch pair on instrument receiving arm 133.

Referring back to FIGS. 13–16, each different type of indexed chiral bladed instrument has a one-to-one correspondence with an indexed slotted member 444. An index indentation distance (such as 432*a*or 432*b*) equal to the corresponding index protrusion distance in indexed slotted member 444 allows one type of instrument to fit into one slot design. Each indexed slotted member fits into only one of the notch pairs. Consequently, an operator can only insert an indexed slotted member into the correct notch pair.

To use the inventive system, an operator selects the appropriate indexed slotted member that includes the index protrusion pattern that corresponds to the index indentation pattern in the instrument to be sharpened. The indexed slotted member is inserted into the block 442. The instrument and slotted member are aligned to allow the index indentations and the index protrusions to matingly engage. Hence the proper longitudinal and axial positions of the blade of the instrument in the indexed slotted member are achieved. The operator then clamps the positioned instrument down. The mounting pins of the indexed slotted member are inserted into the appropriate notch pair. The blade is then moved to the sharpening stone for sharpening. Therefore, the combination of the notch pair used, and the longitudinal and axial position of the instrument in the index slotted member will determine the blade angle that will be imparted on the blade.

Specific embodiments of a novel dental instrument sharpening system and method have been described for the purposes of illustrating the manner in which the invention is made and used. It should be understood that the implementation of other variations and modifications of the invention, in its various aspects, will be apparent to those of ordinary skill in the art and that the invention is not limited by the specific embodiments disclosed herein. For example, the combination of an index pin in the grommet and index protrusions in the slotted member may also be used to properly position an instrument.

What is claimed is:

1. A chiral bladed dental instrument having a hollow handle with an outer surface and a chiral blade at opposing ends thereof, the improvement comprising: a plurality of index indentations located in the outer surface of the handle for matingly engaging with a corresponding clamping mechanism, at least two of said index indentations being separated by an indentation distance that is dependent upon the desired blade angle to be imparted.

2. The instrument of claim 1 wherein the handle includes at least two distinct sets of index indentations where one set corresponds to one of the chiral blades and the other set corresponds to the second chiral blade.

3. The instrument of claim 1 wherein the plurality of index indentations are dimples having a conical shape.

4. The instrument of claim 1 wherein the index indentations form a triangular pattern and are on corners of the outer surface.

5. The instrument of claim 1 wherein the index indentations form a triangular pattern and are on flat surfaces of the outer surface of the instrument and the indentation distance is a longitudinal indentation distance.

6. The instrument of claim 1 wherein a set of index indentations corresponds with a unique index slotted member.

7. The instrument of claim 1 wherein the index indentations engage with the clamping mechanism and determine the longitudinal and axial position of the blade for sharpening.

8. The instrument of claim 1 wherein the index indentations form a triangular pattern wherein a pair of indentations at a base of the triangular pattern are separated by less than 180 degrees and are separated from a remaining index indentation at a tip of the triangular pattern by the indentation distance.

* * * * *